US006843615B1

(12) United States Patent
Cook et al.

(10) Patent No.: US 6,843,615 B1
(45) Date of Patent: Jan. 18, 2005

(54) COMPACTION ROLLER

(75) Inventors: Eric Johnstone Cook, Nigel (ZA); Christoffel Avril Mijburgh, Benoni (ZA)

(73) Assignee: Compaction Technology (Soil) Limited, Harrow (GB)

( * ) Notice: Subject to any disclaimer, the term of this patent is extended or adjusted under 35 U.S.C. 154(b) by 0 days.

(21) Appl. No.: 09/830,403

(22) PCT Filed: Nov. 8, 1999

(86) PCT No.: PCT/IB99/01784

§ 371 (c)(1),
(2), (4) Date: Jun. 12, 2001

(87) PCT Pub. No.: WO00/28155

PCT Pub. Date: May 18, 2000

(30) Foreign Application Priority Data

Nov. 9, 1998 (ZA) ..... 98/10205

(51) Int. Cl.[7] ..... E01C 19/26; E01C 19/23
(52) U.S. Cl. ..... 404/124; 404/122
(58) Field of Search ..... 404/124, 122, 404/131, 121

(56) References Cited

U.S. PATENT DOCUMENTS

| | | | | | |
|---|---|---|---|---|---|
| 2,403,812 | A | * | 7/1946 | MacCallum | 152/209.14 |
| 2,909,106 | A | | 10/1959 | Berrange | |
| 3,662,658 | A | | 5/1972 | Berrange | |
| 3,717,380 | A | * | 2/1973 | Eastwood, II | 301/41.1 |
| 3,768,583 | A | * | 10/1973 | Waterman | 180/14.1 |
| 3,788,757 | A | * | 1/1974 | Berrange | 404/124 |
| 3,950,110 | A | * | 4/1976 | Clifford | 172/417 |
| 4,147,448 | A | * | 4/1979 | Jeffery | 172/518 |
| 4,237,984 | A | * | 12/1980 | Cobb et al. | 172/554 |
| 4,422,795 | A | | 12/1983 | Berrange | |
| 5,114,269 | A | * | 5/1992 | Shepherd | 404/122 |
| 5,348,418 | A | * | 9/1994 | Campbell | 404/103 |
| 5,607,255 | A | * | 3/1997 | Thomas et al. | 404/72 |
| 5,860,764 | A | * | 1/1999 | Roberts | 404/124 |
| 6,004,076 | A | * | 12/1999 | Cook et al. | 405/271 |
| 6,379,081 | B1 | * | 4/2002 | Barbulescu | 404/122 |

FOREIGN PATENT DOCUMENTS

| | | | | |
|---|---|---|---|---|
| DE | WO98/24981 | * | 6/1998 | E02D/3/026 |
| GB | WO97/04179 | * | 2/1997 | E02D/3/026 |
| GB | WO 98/51866 | | 11/1998 | |
| WO | WO99/60218 | | 11/1999 | |
| ZA | WO 99/60218 | * | 11/1999 | E02D/3/026 |

* cited by examiner

*Primary Examiner*—Robert E. Pezzuto
*Assistant Examiner*—Raymond W Addie
(74) *Attorney, Agent, or Firm*—Burns, Doane, Swecker & Mathis, LLP

(57) ABSTRACT

The invention concerns a soil compaction roller (10) and a soil compaction machine of which the roller (10) forms part. The roller (10) comprises a multi-sided, out-of-round, peripheral compacting surface (16) which can roll over a soil surface which is to be compacted. The compacting surface (16) is defined by a series of angularly spaced salient points (20) and a corresponding series of compacting faces (22). Each compacting face (22) is outwardly convex in shape and extends continuously between two adjacent salient points (20). When the roller (10) is operative with the compacting surface (16) rolling over the soil surface, the roller rises up on each salient point (20) in turn, storing potential energy, and thereafter rolls downwardly onto the succeeding compacting face (22) to transmit the stored potential energy to the soil surface to compact it. The instantaneous center of rotation of the compacting surface (16), where it contacts the soil surface during rolling, moves continuously about substantially the full extent of the compacting surface.

8 Claims, 2 Drawing Sheets

10
12
14
16
18
20
20.1
22
22.1
24
26
28
30
A
A

COMPACTION ROLLER

BACKGROUND TO THE INVENTION

THIS invention relates to a compaction roller.

Traditionally, soil compaction has been carried out either by means of round rollers with considerable mass or vibratory rollers. In relatively recent times, impact compaction as described in, for instance, the specification of U.S. Pat. No. 2,909,106, has been used in soil compaction activities. Impact compactors have been demonstrated to achieve high levels of soil compaction at some depth below the surface but in some cases they may not be really effective for compaction of layer works where a relatively shallow surface zone of the soil mass has to be compacted. Depending on the soil conditions the impact roller of an impact compactors may have a tendency merely to disturb the surface layer rather than compact it effectively.

The impact roller of a conventional impact compactor may also have a tendency to create localised depressions in the soil surface, requiring subsequent smoothing operations them. They may also generate shock loads both on the towing tractor and on the soil mass and can have a relatively low operating speed.

SUMMARY OF THE INVENTION

According to the invention there is provided a soil compaction roller comprising a multi-sided, out-of-round, peripheral compacting surface which can roll over a soil surface which is to be compacted, the compacting surface being defined by a plurality of angularly spaced salient points and a corresponding plurality of compacting faces, each compacting face being outwardly convex in shape and extending continuously between two adjacent salient points.

Further according to the invention there is provided a soil compaction roller comprising a multi-sided, out-of-round, peripheral compacting surface which can roll over a soil surface which is to be compacted and which is defined by a plurality of angularly spaced salient points and intermediate compacting faces which are outwardly convex in shape and extend between the salient points, whereby when the roller is operative with the compacting surface rolling over the soil surface, the roller rises up on each salient point in turn, storing potential energy, and thereafter rolls downwardly onto the succeeding compacting face to transmit the stored potential energy to the soil surface to compact it, the instantaneous centre of rotation of the compacting surface, where it contacts the soil surface during rolling, moving continuously about substantially the full extent of the compacting surface.

The geometry of the roller is preferably such that the salient points are equi-angularly spaced about a central axis of the roller and are equidistant from that axis, and each compacting face is symmetrical about a radial bisector of the two salient points between which the compacting face extends. The compacting face may be smoothly curved or composed of a plurality of flat facets which in combination form an outwardly convex shape.

Another aspect of the invention provides a soil compaction machine comprising a soil compaction roller as summarised above. The machine may have a pair of the rollers arranged side by side with one another.

In the dual roller configuration there are various possibilities. For instance, the soil compaction rollers may be mounted on a common axle in the manner described for impact compaction rollers in ZA80/2099 (=EP 0 017 511). Alternatively the rollers may be suspended independently on separate axles as described for impact compaction rollers in PCT/IB99/00906. The machine may be self-propelled as described for an impact compaction machine in PCT/GB96/01708 (WO 97/04179), or it may include coupling means for coupling it to a tractive vehicle such as a tractor. The machine may also incorporate an auxiliary drive arrangement for delivering an auxiliary rotary driving force to the rollers as described for a dual roller impact compaction machine in PCT/GB98/01400 (WO 98/51866).

BRIEF DESCRIPTION OF THE DRAWINGS

The invention will now be described in more detail, by way of example only, with reference to the accompanying drawings in which.

DESCRIPTION OF PREFERRED EMBODIMENTS

Figures 1, 2, 3, 4:
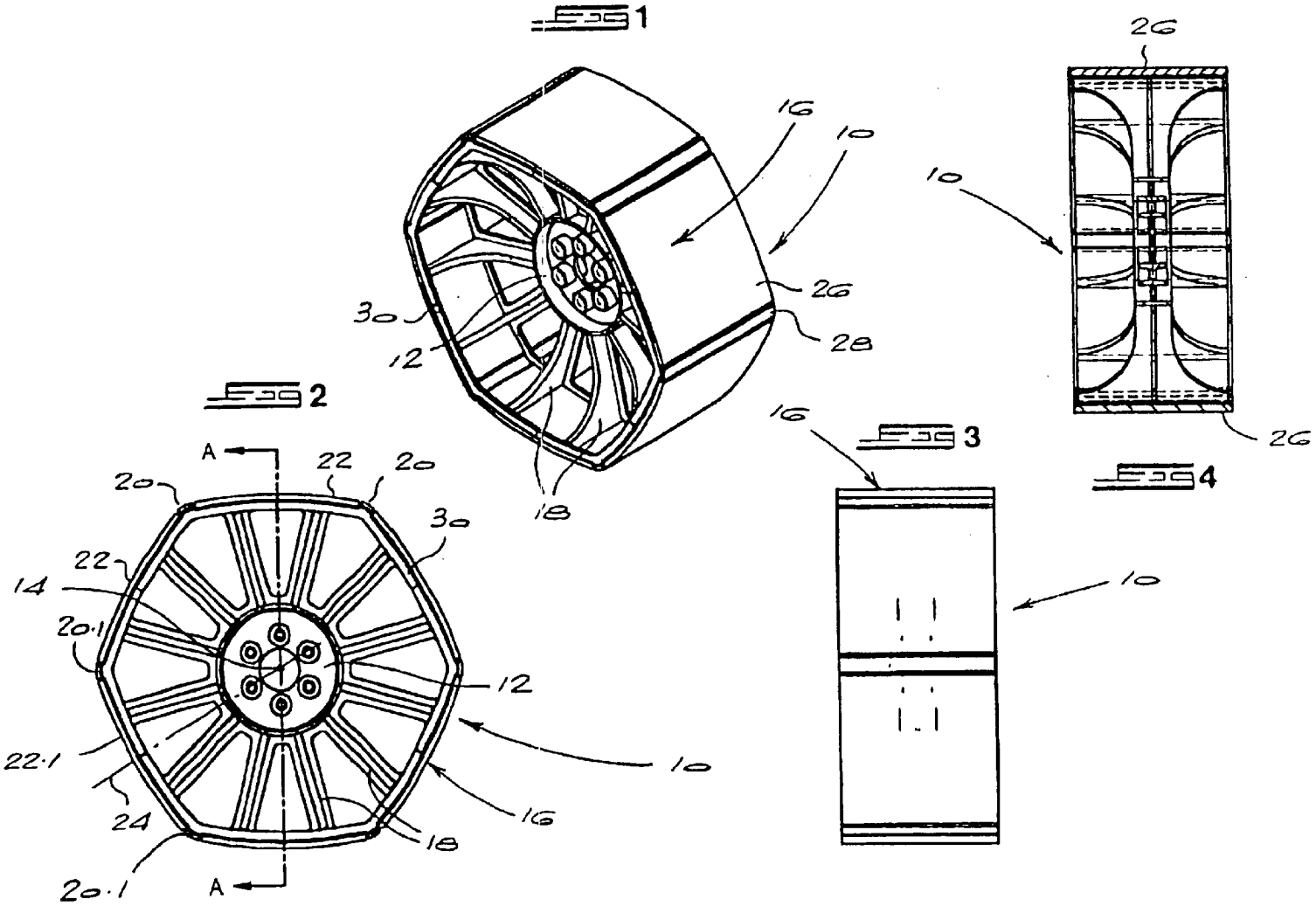
FIG. 1 shows a perspective view of a compaction roller according to this invention.
FIG. 2 shows a side view of the compaction roller.
FIG. 3 shows an end view of the compaction roller.
FIG. 4 shows a cross-section at the line A—A in FIG. 2.

The illustrated multi-sided compaction roller 10 has a central hub 12 located on a central axis 14 and a peripheral compacting surface 16 which is joined to the hub by radial spokes 18. The compacting surface 16 is defined by six salient points 20 which are equi-angularly spaced apart and equidistant from the central axis 14, and six intermediate compacting faces 22 extending between the salient points. The compacting faces 22 are identical to one another and each has a smooth, convex curvature which is symmetrical about a radial bisector of the two salient points 20 between which it extends. For example, the compacting face 22.1 is symmetrical about the radial bisector 24 of the two salient points 20.1.

The salient points 20 and faces 22 of the compaction surface 16 are formed by curved wear plates 26 and 28 respectively which are mounted to the ends of the spokes 18. The assembly of plates 26 and 28 is stiffened by ribs 30 which are located at the lateral edges of the plates and which are connected to the plates and to the lateral extremities of the spokes 18.

In operation of the compaction roller 10, the hub 12 is mounted on an axle supported by a carriage which is towed by a suitable towing vehicle, such as a tractor (not shown). In practice, there may be two similar compaction rollers arranged side by side. In this case the compaction rollers may be mounted on a common axle or they may be independently suspended.

The specification of South African patent ZA 80/2099 (=EP 0 017 511) describes an apparatus in which two impact compaction rollers are mounted side by side on a common axle. A similar mounting arrangement may be used to mount compaction rollers 10 on a common axle.

Figure 5:
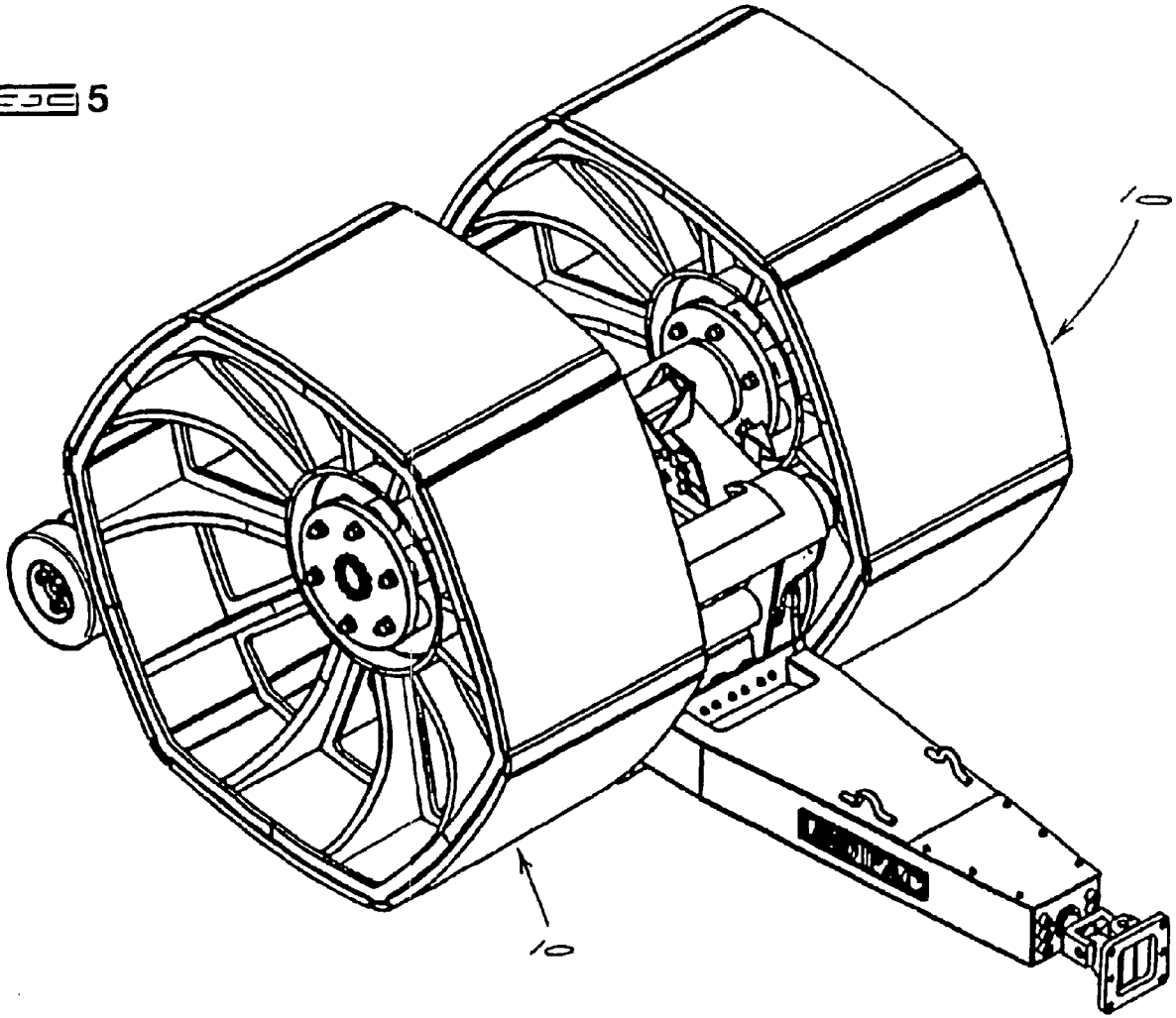
FIG. 5 shows a soil compaction machine incorporating two compaction rollers, according to the invention.

PCT/IB99/00906 describes an apparatus in which two impact compaction rollers are suspended independently in a side by side configuration and, once again, a similar mounting arrangement can be used for dual compaction rollers 10, as shown in FIG. 5.

It is also within the scope of the invention for there to be a single compaction roller 10 only, in which case the roller may be mounted in the manner described in the specification of U.S. Pat. No. 2,909,106.

It is also within the scope of the invention for the compaction roller(s) 10 to form part of a self-propelled machine which may, for instance, be of the type described in the specification of PCT/GB96/01708 (WO 97/04179).

EP 0 017 511, PCT/IB99/00906, U.S. Pat. No. 2,909,106 and WO 97/04179 describe impact compaction machines in which each compactor mass, as it rolls over a soil surface which is to be compacted, alternately rises up on a salient point, storing potential energy, and then falls forwardly and downwardly for the stored potential energy to be delivered to the soil surface as an impact blow by a compaction face which follows the salient point. As mentioned previously, while this compaction technique has been proved to be effective to produce high levels of soil compaction at considerable depths below the soil surface, they have several disadvantages at least in some applications.

The compaction roller 10 does not act in the manner of an impact compaction roller. As it rolls over the soil surface, it rises up on each salient point 20 and then rolls forwardly and downwardly onto the succeeding compacting face 22. Potential energy which is stored as the roller rises on a salient point is applied to the soil surface as the roller rolls onto the succeeding face 22, but this happens in a far smoother manner than is the case with an impact compaction roller. This is attributable inter alia to the convex shape of the sides 22 which allows for a smooth transition from each raised, potential energy storage position to a succession of relatively lowered positions as the convex surface of the following face 22 rolls over the soil surface. The instantaneous centre of rotation, i.e. the point at which the compacting surface 16 makes line contact with the soil surface and about which the roller rotates instantaneously relative to the soil surface, moves continuously about substantially the full extent of the surface 16.

The action of the roller 10 may be likened to a continuous kneading action as opposed to the periodic impact action of an impact compaction roller.

The effect of this is that the soil surface experiences compacting pressure throughout the full rotation of the roller 10, i.e. at all angular positions of the roller. As the roller rises onto a salient point 22, the compacting pressure is experienced as a result of the reaction force applied to the soil surface by the roller, and as the roller subsequently rolls forwardly and downwardly onto a compacting face 22, the compacting force is experienced as a result of the stored potential energy being transmitted to the soil surface.

This action is in contrast to the action of an impact compaction roller. In the case of impact compaction rollers having flat sides, the only centres of rotation are at the salient points or corners of the roller.

There is no continuous movement of an instantaneous centre of rotation about the peripheral compacting surface of the roller. In the case of impact compaction rollers having a re-entrant recess between each salient point and the subsequent compacting face, the centre of rotation jumps from the salient point to an angularly spaced point on the compacting face. Hence there is once again no continuous, smooth motion of an instantaneous centre of rotation about the full extent of the peripheral compacting surface.

In contrast to the smooth and continuous application of compacting pressure to the soil surface with the roller 10, both types of impact roller mentioned above apply abrupt, non-continuous pressure spikes to the soil surface, resulting in disturbance of the soil mass adjacent the soil surface but often little effective compaction of that mass.

Because of its ability to apply smooth and continuous pressure to the soil surface, a roller 10, on the other hand, has been demonstrated in initial tests to have the ability to achieve effective compaction right to the surface of a soil mass. This makes the roller 10 eminently suitable for use in compacting layer-works.

Added to this, the smooth application of compacting pressure with the roller 10 results in a relatively smooth, compacted soil surface. This is again in contrast to the operation of an impact compaction roller, where localised indentations are created in the soil surface which must subsequently be smoothed, typically by blading.

With the illustrated roller 10 adequate levels of soil compaction can also be achieved without the substantial shock loads experienced in the operation of an impact compaction roller. This can in turn lead to reduced wear on the compactor itself and on surrounding equipment and structures.

A further advantage of the illustrated roller 10, when compared for instance to impact compaction rollers as seen in the specification of ZA 96/6036, arises from the symmetrical shapes of the sides 22 which allow the roller to be bi-directional, i.e. it can be rotated in either direction over the soil surface, and typically at higher rotational speeds than an impact roller, with comparable results. This is particularly important in cases where rollers 10 are used in a reversible, self-propelled machine.

In the preferred roller 10 the compacting faces are smoothly and convexly curved, but it is within the scope of the invention for these faces to be made up of a large number of narrow, flat facets defining, in combination, a generally convex surface.

PCT/GB98/01400 (WO 98/51866) describes an impact compaction machine which incorporates an auxiliary drive arrangement to apply an auxiliary rotary drive to the impact compactor masses or rollers of the machine. This may be necessary when, for instance, the salient points of the rollers have a tendency to dig into or slide on the soil surface. The auxiliary drive arrangement operates to restore the angular velocity of the rollers for normal operation to continue. It is also within the scope of the present invention for an auxiliary drive arrangement, similar to that described in WO 98/51866, to be incorporated in the compaction machine.

Various other modifications are also within the scope of the invention. For instance, while reference has been made to substantially continuous application of pressure to the soil surface and substantially continuous movement of the instantaneous centre of rotation about the full extent of the compacting surface, minor localised deformations, for instance recesses, in the compacting surface, can be tolerated while still achieving desirable levels of surface compaction.

What is claimed is:

1. A soil compaction roller comprising a hub structure defining a central axis of rotation and a multi-sided, out-of-round, peripheral compacting surface which has a width measured parallel to the axis and which is fixed non-adjustably to an outer periphery of the hub structure so as to be capable of rolling in a direction of rolling over a soil surface that is to be compacted when the hub structure rotates about the central axis, the compacting surface being defined by a plurality of angularly spaced salient points and an equal plurality of compacting faces, the salient points being defined at the ends of respective radii of the roller, each such radius constituting a maximum radius of the compacting surface and being larger than the maximum radii of the compacting faces, each compacting face being generally outwardly convex in shape and each generally convex compacting face extending from one salient point to an adjacent salient point, each salient point extending parallel to the central axis, the cross-section of each generally convex compacting face arranged such that an instantaneous center of rotation of each generally convex compacting face, where that generally convex compacting face contacts the soil surface during rolling, moves continuously about the full extent of the generally convex compacting face, whereby the roller applies a continuous kneading action to the soil surface at all angular positions thereof as it rolls over the soil surface.

2. A soil compaction roller according to claim 1 wherein compacting faces on either side of each salient point are symmetrical with respect to one another about a plane containing the central axis and that salient point.

3. A soil compaction roller according to claim 1 wherein each compacting face is symmetrical about an imaginary radial line extending through the compacting face at a location thereof situated midway between the salient points lying on opposite sides of that compacting face.

4. A soil compaction roller according to claim 3 wherein the salient points are equi-angularly spaced about the central axis and are equidistant from that axis.

5. A soil compaction roller according to claim 4 wherein each compacting face is smoothly, convexly curved.

6. A soil compaction roller according to claim 4 wherein each compacting face comprises a plurality of flat facets which in combination form an outwardly convex shape.

7. A soil compaction roller according to claim 1 wherein the hub structure comprises a central hub, a plurality of spokes extending outwardly from the central hub, and stiffening ribs carried by the spokes at the periphery of the hub structure, to which ribs wear plates are mounted.

8. A soil compaction machine including a pair of soil compaction rollers mounted side by side with one another, each soil compaction roller comprising a hub structure defining a central axis of rotation, a multi-sided, out-of-round, peripheral compacting surface which has a width measured parallel to the axis and which is fixed non-adjustably to an outer periphery of the hub structure so as to be capable of rolling over a soil surface that is to be compacted when the hub structure rotates about the central axis, the compacting surface being defined by a plurality of angularly spaced salient points and an equal plurality of compacting faces, the salient points being defined at the ends of respective radii of the roller, each such radius constituting a maximum radius of the compacting surface and being larger than the maximum radii of the compacting facts, each composing face being generally outwardly convex in shape and each generally convex compacting face extending continuously from one salient point to an adjacent salient point, each salient point extending parallel to the central axis, the cross-section of each generally convex compacting surface being constant across a width thereof measured parallel to the axis and being arranged such that an instantaneous center of rotation of each generally convex compacting face, where that compacting face contacts the soil surface during rolling, moves continuously about the full extent of the generally convex compacting face, whereby the roller applies a continuous kneading action to the soil surface at all annular positions thereof as it rolls over the soil surface, wherein each compacting face is symmetrical about an imaginary radial line extending through the compacting face at a location thereof situated midway between the salient points lying on opposite sides of that compacting face.

* * * * *